US005146968A

United States Patent [19]

Meek

[11] Patent Number: 5,146,968

[45] Date of Patent: Sep. 15, 1992

[54] COMBINED WIPER AND CLUB HEAD COVER

[76] Inventor: William Meek, 1728 Old Ranch Rd., Los Angeles, Calif. 90049

[21] Appl. No.: 642,389

[22] Filed: Jan. 17, 1991

[51] Int. Cl.[5] ..... A63B 57/00

[52] U.S. Cl. ..... 150/160; 206/315.4

[58] Field of Search ..... 150/159, 160; D21/221, D21/234; 206/315.3, 315.4; D6/608; 15/209 R

[56] References Cited

U.S. PATENT DOCUMENTS

| | | | |
|---|---|---|---|
| D. 210,138 | 2/1968 | Forst | D21/221 |
| D. 317,693 | 6/1991 | Jencks et al. | D6/608 |
| 2,471,169 | 5/1949 | Salzberg et al. | 150/159 X |
| 3,548,908 | 12/1970 | Koetting | 150/160 |
| 3,593,769 | 7/1971 | Spears | 150/160 |
| 3,821,976 | 7/1974 | Smith et al. | 150/160 |
| 3,831,652 | 8/1974 | Hyden et al. | 150/160 |
| 3,861,434 | 1/1975 | Harding | 150/160 |
| 3,938,570 | 2/1976 | Stewart | 150/160 |
| 4,498,579 | 2/1985 | Brick | 206/315.4 |
| 4,699,164 | 10/1987 | Pilney et al. | 150/160 X |
| 4,898,222 | 2/1990 | Gaffney | 150/160 |
| 4,971,126 | 11/1990 | Borenstein | 150/160 |

FOREIGN PATENT DOCUMENTS

| | | | |
|---|---|---|---|
| 2133700 | 8/1984 | United Kingdom | 150/160 |

*Primary Examiner*—Sue A. Weaver

*Attorney, Agent, or Firm*—David Weiss

[57] ABSTRACT

A combined wiper and head cover for a golf club, and the method of applying the cover to the club and in particular to a putter. The cover comprises a panel of preferably absorbent material having a portion for engaging the heel of the club head, and fastening means in the vicinity of the heel engaging portion for releasably securing the panel to the club shaft with the panel extending to one side of the shaft and draping over the toe of the club head when the club's head is positioned above its shaft.

18 Claims, 3 Drawing Sheets

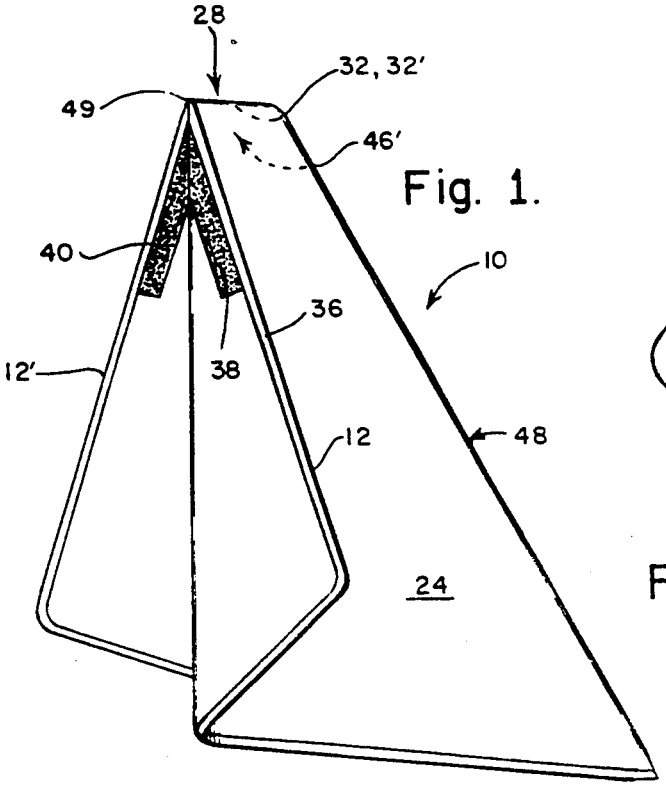
Fig. 1.
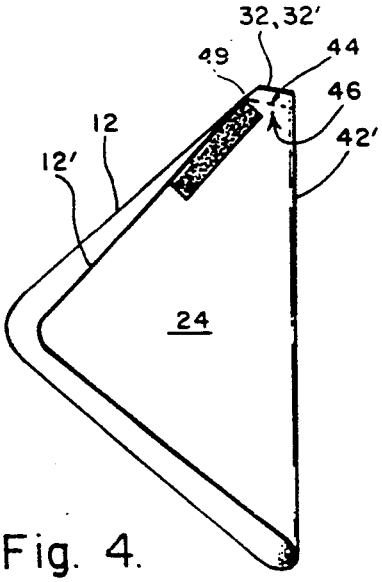
Fig. 4.
Fig. 3.
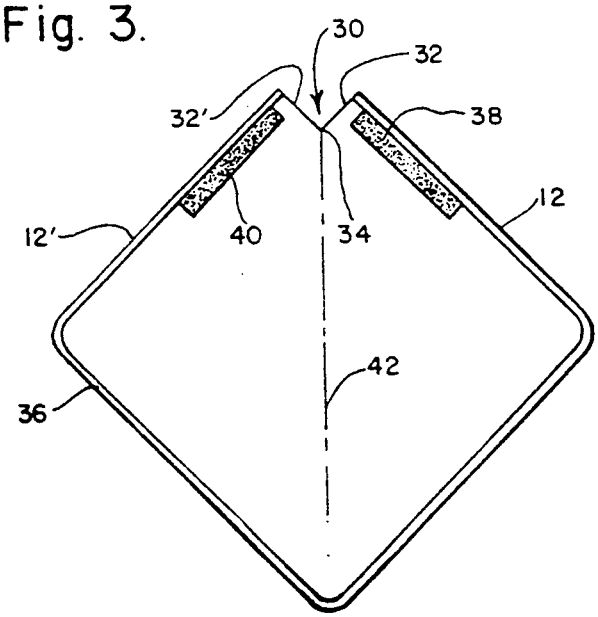
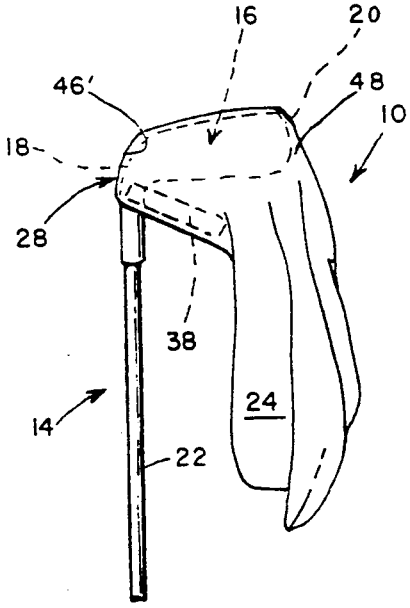
Fig. 2.

Fig. 7.
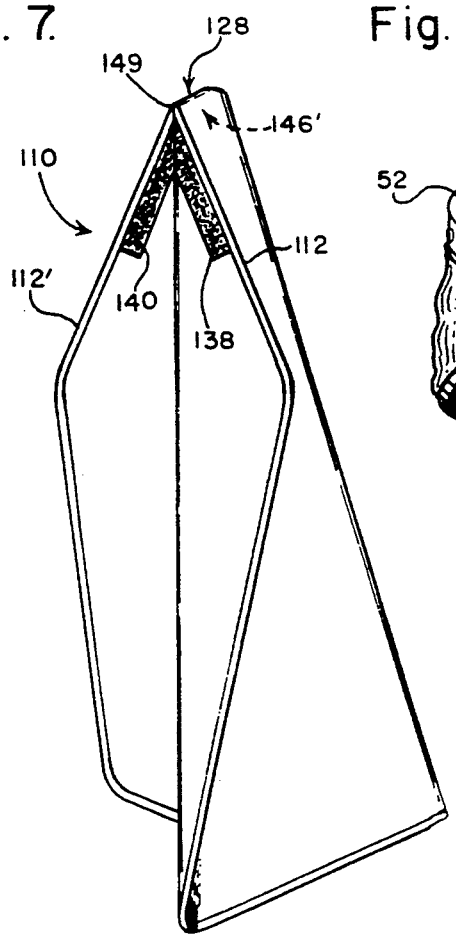
Fig. 5.
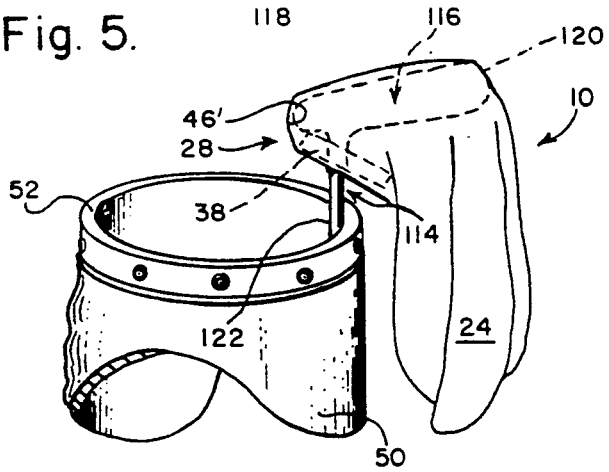
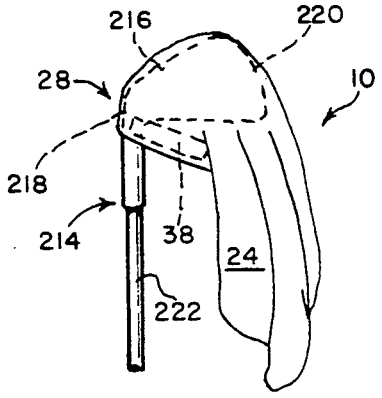
Fig. 6.
Fig. 8.
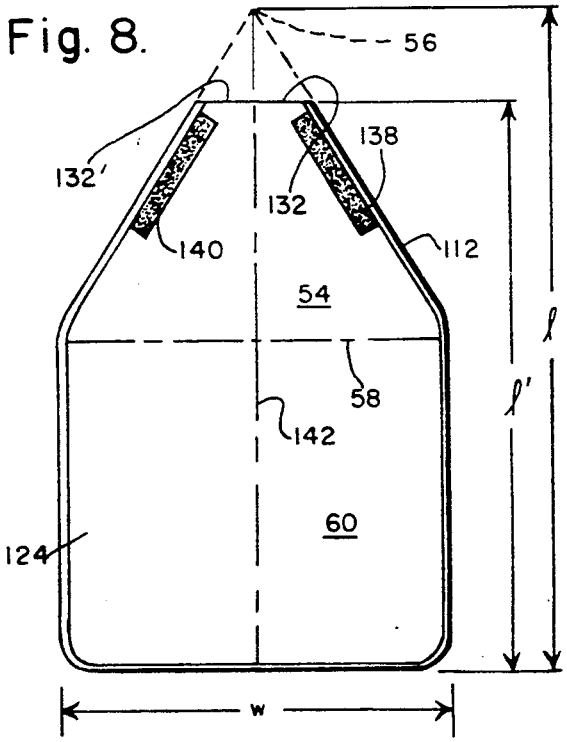
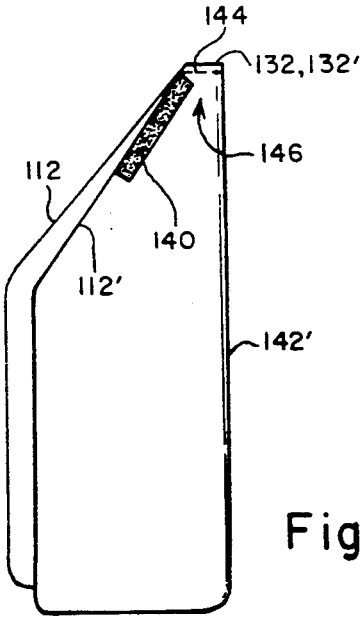
Fig. 9.

COMBINED WIPER AND CLUB HEAD COVER

BACKGROUND OF THE INVENTION

This invention relates to covers for club heads, and more particularly to a head cover for a golf club which may conveniently be used as a wiper for cleaning a golf ball or golf club, as well as to the method of applying the cover hereof to a golf club.

Although golf club head covers exist in various configurations for providing protection for golf club heads while the club is not in actual use, only a few have been developed which are intended to serve an additional purpose of permitting the golfer to utilize the cover as a wiper for cleaning the golf ball or the club during play. One such dual purpose club head cover is disclosed in U.S. Pat. No. 3,938,570, issued to Edra J. Stewart, in which it is pointed out that such dual purpose covers are particularly useful as a putter cover. When a golfer takes the putter to the putting green, he/she removes the dual purpose cover from the putter and may use it to wipe the ball and/or the putter prior to putting. The Stewart device, which is constructed of terry cloth or toweling, includes a head-engaging portion conforming to the configuration to the putter head, a narrowed "waist" portion which may be elasticized for grasping the club shaft, and an elongate skirt portion hanging loosely around a considerable portion of the length of the shaft of the club. The skirt portion may, alternatively, be fastened to furl around the club shaft when the club is not in use.

U.S. Pat. No. 3,831,652, issued to Alsie G. Hyden and Bill J. Blundell, discloses a combined putter head cover and towel, in which a boot-shaped sheath fits over the putter head and may include an elastic band for aiding in the retention of the boot on the putter head. A towel is secured about the peripheral edge of the boot's leg portion and is open along its length, apparently for hanging about the putter's shaft in a manner similar to the cover of the Stewart patent.

In each of these prior art devices, the head-engaging portion is shaped to the configuration of a particular type of putter head for fitting over the entire club head including the head's heel end and the club's distal toe end, and the towel portion substantially surrounds the putter's shaft. It would appear that such devices are not freely usable with different shapes and sizes of golf club heads, or even with different shapes and sizes of putter heads. Moreover, the circumstance of the towel's surrounding the shaft may interfere with the placing of the covered club in the golf club bag, as well as with the placing or withdrawing of other golf clubs in or from the bag containing the covered club. Further, the golfer would not conveniently be able to directly grasp the covered club by its shaft in the vicinity of the club head when withdrawing or replacing the club from or into the bag.

SUMMARY OF THE INVENTION

The foregoing disadvantages of prior art combined wiper and club head cover devices are overcome by means of the present invention wherein a combined wiper and club head cover device is provided which may be used with golf clubs having heads of various sizes or shapes and particularly with putters having heads of various sizes or shapes. The device of the present invention does not surround the club shaft but instead is disposed away from the shaft and drapes over an end of the club, so that the covered club may be positioned in the golf bag with the draped portion of the device disposed outside the periphery of the golf club bag. The manner in which the cover is disposed precludes interference with other clubs in the bag while permitting the covered club to be withdrawn from and returned to the golf club bag with ease and convenience not previously available with prior art combined wiper and head cover devices.

In describing the head cover of the present invention, it is recognized that a club to be utilized with the head cover includes a head attached to a shaft, the head including two opposed ends conventionally referred to as the heel and the toe of the club head. Briefly described, the head cover of the present invention comprises a panel of pliant material such as cloth; means for engaging the panel with a first end of the club head such that the panel drapes from or over the second end of the club head when the club is vertically positioned with its head above its shaft; and means for releasably securing the panel to the club shaft with the engaging means engaging the first end of the club head such that the panel extends away from the shaft.

The panel, which is preferably of terry cloth or toweling material, includes an end-engaging portion inwardly extending from an edge of the panel, for engaging the first end of the club head; and the cover includes fastening means along the panel's edge in the vicinity of the panel's end-engaging portion, for releasably securing the panel to the club shaft with the end-engaging portion engaging the head's first end and with the panel covering the club head and draping over the head's second end when the club is vertically positioned with its head above its shaft.

The panel may be considered as including two edges joined at the end-engaging portion. The fastening means, which is preferably a quick-fastening and quick-release device such as cooperating strips of mating hooks and loops marketed under the trademark Velcro, is situated at the panel edges in the vicinity of the end-engaging portion for releasably securing the panel to the club shaft with the end-engaging portion engaging the head's first end and with the panel covering the club head and draping over the second end of the head when the club is vertically positioned with the head above the shaft.

In accordance with another consideration of the present invention, the cover comprises a pliant panel having a body portion and a head-engaging portion for engaging the first end of the club head, the panel including two edges joined at the head-engaging portion; fastening means at such edges in the vicinity of the head-engaging portion for releasably securing the panel to the club shaft with the body portion extending away from the shaft and the head-engaging portion engaging the head's first end; the body portion extending from the head-engaging portion for draping over the second end of the head when the panel is secured to the shaft by the fastening means and the club is vertically positioned with its head above its shaft.

The club's first end is preferably its heel end, and the club's second end is preferably its distal toe end. Accordingly, the cover of the present invention may be considered as comprising a pliant or cloth panel having a body portion and a heel-engaging portion for engaging the heel of the club head, the panel including two edges joined at the heel-engaging portion; fastening means at the panel's edges in the vicinity of the heel-engaging portion for releasably securing the panel to the club shaft with the heel-engaging portion engaging the heel end; the body portion extending from the heel-engaging portion for covering the club head and draping over the distal toe end when the panel is secured to the shaft by the fastening means and the club is vertically positioned with its head above its shaft.

The invention further comprises, in combination, a golf club having a head with a first end and a second end, and a shaft attached to the head; a cloth panel; means engaging the panel with the first end of the club head such that the panel covers the head and drapes over its second end when the club is vertically positioned with its head above its shaft; and means releasably securing the panel to the club shaft with the panel extending away from the shaft.

According to another aspect hereof, the present invention includes a method of covering a golf club head, comprising the steps of providing a golf club having a head attached to a shaft, the head including a first end and an opposed second end; providing a panel of pliant material; engaging the panel with the first end of the head such that the panel covers the head and drapes over the second end when the club is vertically positioned with its head above its shaft; and releasably securing the panel to the shaft in the vicinity of the head such that the panel extends away from the shaft. The club head's first end is preferably the heel end of the head and the second end is preferably the distal toe end of the head, and during the securing step the panel extends toward the distal toe end. The method further includes the steps of providing a golf bag for carrying the golf club with its head above its shaft; and placing the golf club with the panel secured thereto in the golf club bag with the club's head above its shaft and with the drape of the secured panel disposed peripherally outside the bag.

BRIEF DESCRIPTION OF THE DRAWING

The novel features which are believed to be characteristic of the invention, together with further advantages thereof, will be better understood from the following description considered in connection with the accompanying drawings in which preferred embodiments of the invention are illustrated by way of example. It is to be expressly understood, however, that the drawings are for the purpose of illustration and description only and are not intended as a definition of the limits of the invention.

FIG. 1 is a perspective view of a preferred embodiment of a combined wiper and golf club cover according to the present invention;

FIG. 2 is a perspective view of the cover of FIG. 1 shown secured to a golf putter in accordance with the method hereof;

FIG. 3 is a plan view of a cloth panel for constructing the preferred embodiment of FIG. 1, prior to sewing;

FIG. 4 is a perspective view of the panel of FIG. 3, after sewing;

FIG. 5 is a perspective view of the cover of FIG. 1 shown secured to another type of golf putter, the putter positioned in a golf club bag in accordance with the method hereof;

FIG. 6 is a perspective view of the cover of FIG. 1 secured to yet another type of golf club;

FIG. 7 is a perspective view of an alternative embodiment of a combined wiper and golf club cover according to the present invention;

FIG. 8 is a plan view of a cloth panel for constructing the alternative embodiment of FIG. 7, prior to sewing;

FIG. 9 is a perspective view of the panel of FIG. 8, after sewing;

Figure 10:
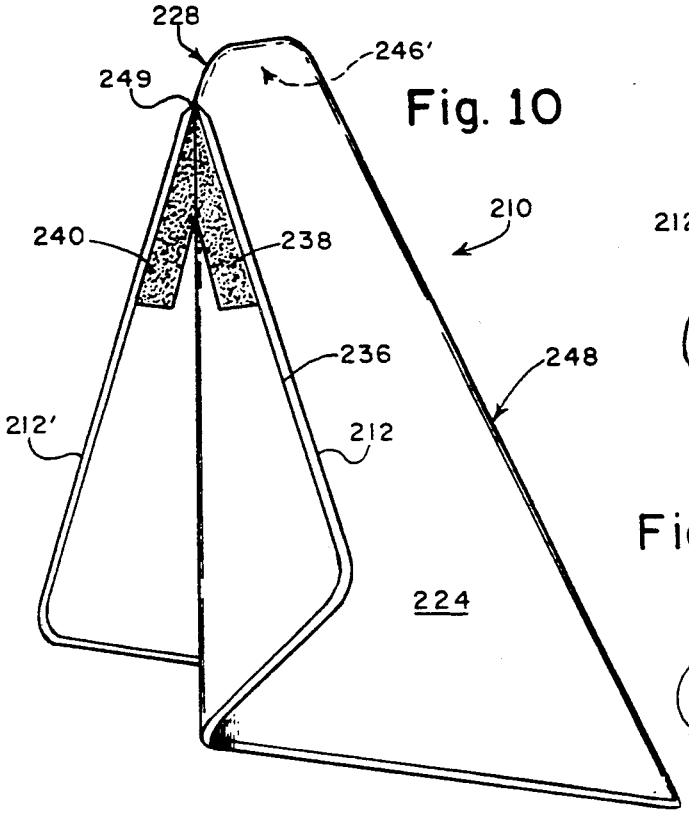
FIG. 10 is a perspective view of a second alternative embodiment of a combined wiper and golf club cover according to the present invention.

Turning first to FIG. 1, a golf club head cover 10 according to the present invention is shown with an edge 12 folded back for clarity of presentation, while the cover 10 is shown in FIG. 2 secured to a golf club 14 (which is a putter) and covering the club's head 16 (shown in phantom). The club's head 16 is conventionally regarded as having a heel end 18, positioned at the rear of the club 14 when being used by a golfer, and an opposed toe end 20 which is distant from the point of attachment of the head 16 to the golf club's shaft 22.

The cover 10 includes a panel 24 of pliant material, preferably a water absorbent cloth such as terry cloth or toweling, although absorbent paper with high tear strength or other disposable cloth-like materials may be employed.

The cover panel 24 includes a "heel-engaging" or "head-engaging" portion 28, for engaging the heel 18 of the club head 16. Use of the term "engaging the heel" is meant to connote that the portion 28 is intended to be placed at or about the heel end 18 of the club head 16, and it is not required that the portion 28 be in fitting contact with the heel end 18 although such is possible. The heel-engaging portion 28 shown in FIGS. 1 and 2 is configured for facilitating "engaging" the heel end 18 such that the panel 24 may be positioned to overlie and cover the club head 16 and to drape from or over the head's toe end 20 when the club 14 is positioned with its head 16 above its shaft 22 as shown in FIG. 2.

Fabrication of the cover 10 with its configured heel-engaging portion 28 is described with reference to FIGS. 3 and 4. FIG. 3 shows the cloth panel 24, which may be in the form of a square with one corner removed to form a V-shaped notch 30 having sides 32, 32' of substantially equal length extending from a nadir 34 to the panel's edges 12, 12'. The edges 12, 12' may be hemmed, if desired, as indicated by the hem 36. In one example, the nominal dimensions of the square panel 24 are approximately 15 inches in width and 15 inches in length, and each notch side 32, 32' is approximately 1.75 inches, although other dimensions are of course possible.

Strips of cooperating fastening material such as sold under the trademark VELCRO are secured (such as by sewing) to the panel 24 at or along the edges 12, 12' respectively and equally spaced from the notch sides 32, 32' so that the strips 38, 40 will mate when the panel 24 is folded along an axis 42 extending from the notch nadir 34 and bisecting the panel 24. As is well known, VELCRO fasteners include a hook device for mating with a loop device when pressed into contact, so that the strip 38 may comprise the VELCRO hook device while the strip 40 may comprise the VELCRO loop device. Since the panel 24 of the preferred embodiment is preferably terry cloth or toweling which normally is comprised of thread loops, the VELCRO loop strip 40 may be omitted although its presence is preferred. In one example, the strips 38, 40 are sewn along the sides 12, 12' of the panel 24 with the space between the strips 38, 40 and their respective notch sides 32, 32' sufficient to permit the sides 32, 32' to be sewn as later described (say approximately ¼ or ½ inch), and the strips 38, 40 are approximately 3.5 inches in length, although the spacing and the strip dimensions may vary.

To complete the fabrication of the cover 10, the panel 24 is folded along the axis 42, with the strips 38, 40 on the outside of the folded panel as shown in FIG. 4. The panel 24 is sewn along the superposed V-notch sides 32, 32' from the fold 42' to the superposed edges 12, 12', as indicated by stitches 44. After such sewing has been completed, the panel 24 is turned inside out at the recess or pocket 46 formed by the stitched edges, resulting in the completed golf club head cover 10 shown in FIG. 1. (It is noted that the edge hem 36 is not shown in FIG. 4 so that the stitches 44 may be clearly indicated.)

The heel-engaging portion 28 of the cover 10 shown in FIG. 1 includes the sewn edges 32, 32' and corresponds to the pocket 46 shown in FIG. 4, so that the heel-engaging portion 28 formed by the sewn edges 32, 32' includes its own recess or pocket 46'. The remainder of the panel 24 may be considered as comprising a body portion 48 extending from the heel-engaging portion 28. The panel's edges 12, 12' are joined at the heel-engaging portion 28 with the fastening strips 38, 40 secured to the panel at or along the edges 12, 12', respectively, in the vicinity of the heel-engaging portion 28 and preferably extending from the heel-engaging portion 28 or from the junction 49 of the edges 12, 12' and the sewn notch sides 32, 32'. An alternative manner of describing this feature of the cover 10 is to consider that the panel 24 includes a free edge (previously described as the two edges 12, 12'), with the heel-engaging portion 28 (or the pocket 46') inwardly extending from such edge, and the fastening strips 38, 40 being situated at or along such edge with the heel-engaging portion 28 (or the pocket 46') therebetween.

The method of the present invention comprises the steps involved in applying the cover 10 to the golf club 14. Returning to FIG. 2, the heel-engaging portion 28 of the cover 10 is applied to the club head 16, engaging the heel end 18, i.e. the pocket 46' of the heel-engaging portion 28 is placed at the heel 18 such that the panel's body portion 48 covers the head 16 and drapes over the head's distal toe end when the club is vertically positioned with its head 16 above its shaft 22. The two VELCRO fastening strips 38, 40, which are situated below the club head 16, are pressed together for being fastened to one another at and extending forwardly of the shaft 22. The panel 24 is thereby releasably secured to the shaft 22 in the vicinity of the head 16 in such manner that the panel 24 is urged to extend away from the shaft and generally toward the distal toe end 20 of the club head 16.

The cover 10 of the present invention and its manner of application to the club 14, cause the secured cover to extend away from and be confined to one side of the golf club shaft 22 as shown in FIG. 2. This permits the covered putter to be placed in a golf club bag in such manner that the hanging cloth panel 24 does not interfere with such placement, or with the placement or withdrawal of other golf clubs in or from the bag. Turning to FIG. 5, it may be appreciated that such results are accomplished by placing the putter with the panel 24 secured thereto in the golf club bag 50 with the putter's head above its shaft, and with the resulting drape of the secured panel 24 disposed outside the periphery 52 of the bag 50.

When withdrawing the covered putter from the golf bag, the golfer may grasp the club's shaft in the vicinity of the club's head without interference from the cover 10 which extends away from the club's shaft. At the putting green, the golfer removes the cover 10 from the putter by pulling apart or unfastening the mated VELCRO strips 38, 40. He/she may then use the cover to wipe the golf ball and/or the putter.

As indicative of the adaptability of the cover 10 for utilization with golf clubs having heads of different sizes and shapes, the golf club 114 of FIG. 5 is shown as having a head 116 of a popular type with a rearwardly protruding heel 118. The pocket 46' of the cover's heel-engaging portion 28 receives the club's protruding heel 118 with the panel 24 covering the head 116 and extending toward and draping over the putter's toe end 120. The head cover 10 is secured to the club shaft 122 by the VELCRO hook strip 38 being fastened to its mating loop strip 40 (not shown) both rearwardly and forwardly of the shaft 122, with the panel 24 extending away from the shaft 122 and generally toward the putter's toe end 120.

In similar manner, FIG. 6 shows yet another type of golf club 214, such as one of the clubs conventionally referred to as an iron, having a head 216 of a configuration different from that of a putter, upon which has been installed the head cover 10 of the present invention. For example, particular advantage would be realizable when the cover 10 is utilized with sand or chipping wedge types of golf clubs which are typically employed in situations wherein wiping the golf ball and/or the wedge head may be desirable. The heel-engaging portion 28 of the cover 10 engages the heel end 218 of the club head 216, covering the head 216 and extending toward and draping over the head's toe end 220. The cover 10 is secured to the club shaft 214 by the strip 38 being fastened to its mating strip 40 beneath the heel 216 and forwardly of the shaft 222, with the panel 24 extending away from the shaft 222 and generally toward the club's toe end 220.

In FIGS. 7, 8 and 9, there is shown an alternative embodiment 110 of the cover of the present invention, which includes a modification to the cover's heel-engaging portion but is functionally similar to the cover 10, and which further provides a more lengthy drape. The example of panel 124 of the alternative cover 110, as viewed in FIG. 8 before sewing, is configured from a cloth sheet including an isosceles triangle 54 having a phantom base 58 forming a side of a depending rectangle 60, with the triangle's apex 56 (shown in phantom) cut either to form the V-notch 30 as in FIG. 3, or to form the straight top side bisected by the axis 142 to include equal segments 132, 132' each perpendicular to the bisecting axis 142. In one suitable example, the width w of the cover panel 124 is approximately 15 inches, while its length l (extending from the base of the rectangle 60 to the imaginary apex 56 of the triangle 54)

is approximately 23 inches (i.e. the actual length 1' being slightly less than the phantom length 1 or approximately 21 inches). The side segments 132, 132' are each preferably approximately 1.75 inches in length. A VELCRO hook fastener 138 and mating loop fastener 140 are secured to the panel 124 along the panel's edges 112, 112' in similar manner and location as the fasteners 138, 140 of the panel 24 of FIG. 3, spaced however from the side segments 132, 132' rather than from the notch sides 32, 32'.

The alternative panel 124 is folded along the fold line 142' corresponding to the axis 142, and the superposed side segments 132, 132' are secured together such as by sewing with stitches 144 for producing the pocket 146, as shown in FIG. 9. After completion of such sewing, the panel 124 is turned inside out at the recess or pocket 146, resulting in the completed golf club head cover 110 shown in FIG. 7 with its heel-engaging portion 128 including the sewn edges 132, 132' and including its own recess or pocket 146' corresponding to the pocket 146 of FIG. 9. The remainder of the panel 124 may be considered as comprising a body portion 148 extending from the heel-engaging portion 128. The panel's edges 112, 112' are joined at the heel-engaging portion 128 with the fastening strips 138, 140 secured to the panel at or along the edges 112, 112' respectively, in the vicinity of the heel-engaging portion 128 and preferably extending from the heel-engaging portion 128 or from the junction 149 of the edges 112, 112' and the sewn sides 132, 132'. An alternative manner of describing this feature of the cover 110, as previously discussed with respect to the cover 10, is to consider that the panel 124 includes a free edge (previously described as the two edges 112, 112'), with the heel-engaging portion 128 (or the pocket 146') inwardly extending from such edge, and the fastening strips 138, 140 being situated along such edge with the heel-engaging portion 128 (or the pocket 146') therebetween.

The alternative cover 110 is secured to a golf club in the same manner as the preferred cover 10 is secured to a golf club. It may be appreciated, however, in view of the greater length of the body portion 148 of the panel 124, that the secured alternative cover 110 would result in a longer drape than that provided by the cover 10. It may also be appreciated that, with respect to the cover 10 of FIG. 1, the V-notch 30 of the panel 24 (FIG. 3) may be dispensed with and the straight side segments 132, 132' of FIG. 8 substituted for the V-notch sides 32, 32'.

Figure 12:
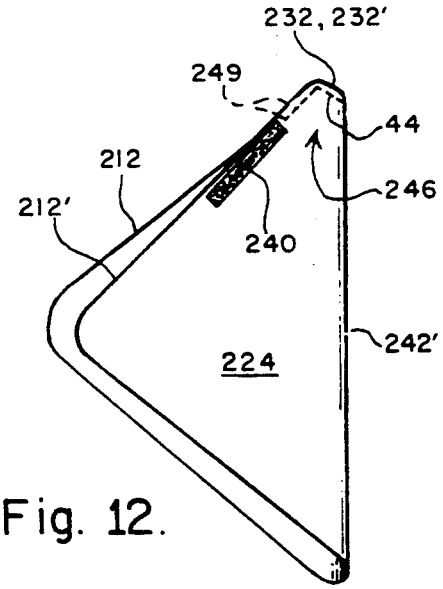
FIG. 12 is a perspective view of the panel of FIG. 11, after sewing.
Figure 11:
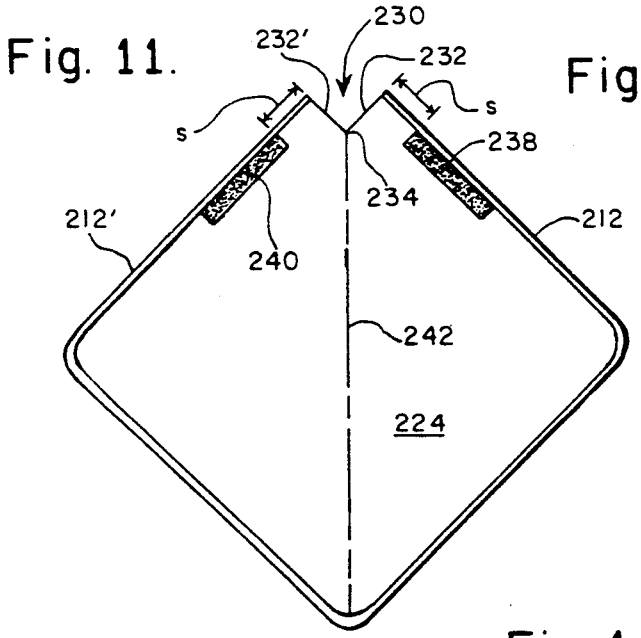
FIG. 11 is a plan view of a cloth panel for constructing the second alternative embodiment of FIG. 10, prior to sewing.

The second alternative embodiment 210 of the cover of the present invention, shown in FIG. 10, 11 and 12, is similar to the cover 10 of FIG. 1 but provides a deeper recess or pocket 246' of the heel-engaging portion 228. The last two digits of the three-digit reference numerals in FIGS. 10–11 are utilized to identify elements corresponding to elements of FIGS. 1, 3 and 4 which are identified by corresponding two-digit reference numerals.

Fabrication of the cover 210 with its more deeply configured heel-engaging portion 228 is described with reference to FIGS. 11 and 12, showing the cloth panel 224 in the form of a square with one corner removed to form the V-shaped notch 230 having sides 232, 232' of substantially equal length extending from the nadir 234 of the panel's edges 212, 212'. Although a square panel 224 is described, other panel configurations (such as the panel configuration shown in FIG. 8) may be employed. Furthermore, although a V-notch 230 is described, the top (as viewed in FIG. 11) of the panel 224 may be cut in the same manner as shown in FIG. 8, so that the straight side segments 132, 132' may be substituted for the V-notch sides 232, 232' in FIG. 11.

The VELCRO strips 238, 240 are secured (such as by sewing) to the panel 224 at or along the edges 212, 212' respectively and equally spaced from the notch sides 232, 232' so that the strips 238, 240 will mate when the panel 224 is folded along the axis 242 extending from the notch nadir 234 and bisecting the panel 224. In this second alternative cover 210, the strips 238, 240 are positioned such that there is a space s along the panel edges 212, 212' between the strips 238, 240 and their respective notch sides 232, 232'; this space s may be approximately the same length as the notch sides 232, 232'. In one suitable example, the normal width and length of the square panel are approximately 15 inches, the notch sides 232, 232' are approximately 1.75 inches, the spaces s are approximately 1.75 inches, and the strips 238, 240 are approximately 3.5 inches in length, although other dimensions are of course possible.

To complete the fabrication of the cover 210, the panel 224 is folded along the axis 242, with the strips 238, 240 on the outside on the folded panel 224 as shown in FIG. 12. The panel 224 is sewn along the superposed notch sides 232, 232' and continuing along the superposed edges 212, 212' toward the VELCRO strips 238, 240, as indicated by stitches 244. After such sewing has been completed, the panel 224 is turned inside out at the recess or pocket 246 formed by the stitched edges, resulting in the completed golf club head cover 210 shown in FIG. 10. The heel-engaging portion 228 of the cover 210 includes the sewn edges 232, 232' continuing along the sewn portion of the edges 212, 212' and ending at junction 249 where the unsewn or free edges 212, 212' join the stitched portion of the edges 212, 212'. This heel-engaging portion 228 corresponds to the pocket 246 shown in FIG. 12, so that the heel-engaging portion 228 formed as described includes its own recess or pocket 246'. The panel's free edges 212, 212' are joined at the heel-engaging portion 228 with the fastening strips 238, 240 situated at or along the edges 212, 212', respectively, in the vicinity of the heel-engaging portion 228 and preferably extending from the heel-engaging portion 228 or from the junction 249 of the free edges 212, 212'. An alternative manner of describing this feature of the cover 210 is to consider that the panel 224 includes a free edge (previously described as the two free edges 212, 212'), with the heel-engaging portion 228 (or the pocket 246') inwardly extending from such edge, and the fastening strips 238, 240 situated at or along such free edge with the heel-engaging portion 228 (or the pocket 246') therebetween.

Figure 13:
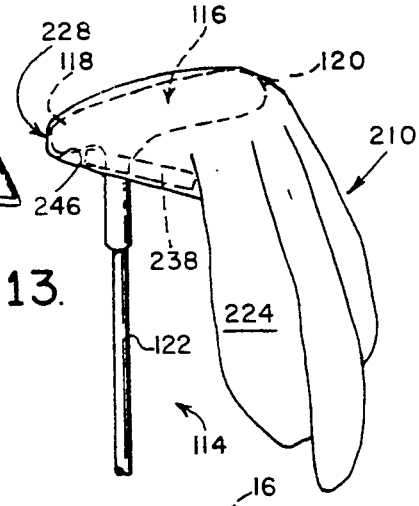
FIG. 13 is a perspective view of the cover of FIG. 10 shown secured to a golf putter of the type shown in FIG. 5.
Figure 14:
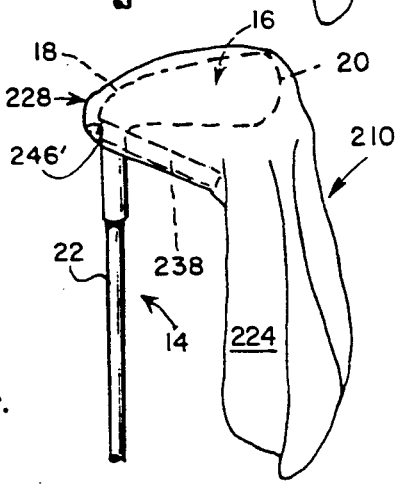
FIG. 14 is a perspective view of the cover of FIG. 10 shown secured to a golf putter of the type shown in FIG. 2.

The method of applying the head cover 210 to a golf club is similar to the application of the cover 10 to a golf club, as previously described. However, the deepened pocket 246' of the heel-engaging portion 228 of the cover 210 produces variations in the manner in which the heel-engaging portion 228 engages the heel end of different type putters and other golf clubs. For example, as shown in FIG. 13, the pocket 246' of the cover 210 is configured to more fittingly receive the protruding heel 118 of a golf club head 116 of the type shown in FIG. 5. The cover 210 is secured to the club shaft 122 by the VELCRO hook strip 238 being fastened to the mating loop strip 40 (not shown) beneath the head 116 and substantially forwardly of the shaft 122 of the club 114, with the panel 224 extending away from the shaft 122 and generally toward the putter's toe end 120. In cases where the golf club's heel 18 does not rearwardly protrude, such as the putter head 16 of FIG. 14 which is similar to the putter-type shown in FIG. 2, the deeper pocket 246' of the heel-engaging portion 228 results in a looser fit between the heel-engaging portion 228 and the heel 18 of the club head 16 when the VELCRO strips 238, 240 are fastened beneath the head 16 and forwardly of the shaft 22 of the club 14, with the panel 224 extending away from the shaft 22 and generally toward the putter's toe end 20.

Thus, there has been described a combined wiper and golf club head cover and a method of its utilization with golf clubs (particularly putters) having heads of various sizes or shapes, and when secured to the golf club the cover extends away from the club's shaft and drapes over the toe end of the club head. The club with secured cover may be positioned in a golf bag with the cover's draped portion disposed outside the periphery of the bag, without interfering with access to the other golf clubs in the bag, and permitting the covered club or putter to be withdrawn from and returned to the bag with ease and convenience not previously available with prior art combined wipers and club covers. Other embodiments and configurations of the combined wiper and club cover of the present invention, and of methods for its utilization, may be developed without departing from the essential characteristics thereof. For example, it should be recognized that although VELCRO fastening means are preferred, other types of fastening means for releasably securing the cover to the club shaft may be utilized, such as mating snaps or zippers or button/-button hole arrangements. Accordingly, the invention should be limited only by the scope of the claims listed below.

I claim:

1. A head cover for a club having a head attached to a shaft, the head including a first end and an opposed second end, the cover comprising:

a panel of pliant material;

means for engaging said panel with the first end of the club head such that said panel drapes over the second end of the club head when the club is vertically positioned with the head above the shaft; and means for releasably securing said panel to the club shaft with said engaging means engaging the first end of the club head such that said draping panel extends away from the shaft and substantially confined to one side of the shaft.

2. A combined wiper and head cover for a golf club having a head attached to a shaft, comprising:

a panel of pliant material having an end-engaging portion inwardly extending from an edge of said panel for engaging a first end of the club head; and fastening means along said edge in the vicinity of said end-engaging portion for releasably securing said panel to the club shaft with said end-engaging portion engaging the head's first end and with said panel covering the club head and draping over a second end of the head when the club is vertically positioned with the head above the shaft.

3. The combined wiper and head cover according to claim 2, wherein said fastening means extends said panel generally toward the second end of the club head when securing said panel to the club shaft.

4. The combined wiper and head cover according to claim 2, wherein said fastening means includes two cooperating fastening devices secured at said edge with said end-engaging portion between said two fastening devices.

5. The combined wiper and head cover according to claim 2, wherein said pliant material is absorbent.

6. A combined wiper and head cover for a golf club having a head attached to a shaft, comprising:

a panel of pliant material having an end-engaging portion for engaging a first end of the club head, said panel including two edges joined to one another at said end-engaging portion; and fastening means at said edges in the vicinity of said end-engaging portion for releasably securing said panel to the club shaft with said end-engaging portion engaging the head's first end and with said panel covering the club head and draping over a second end of the head when the club is vertically positioned with the head above the shaft.

7. The combined wiper and head cover according to claim 6, wherein said panel is urged away from the shaft and generally toward the head's second end by said fastening means securing said panel to the shaft with said end-engaging portion engaging the head's first end.

8. A combined wiper and head cover for a golf club having a head attached to a shaft, comprising:

a panel of pliant material having a body portion and a head-engaging portion for engaging a first end of the club head, said panel including two edges joined to one another at said head-engaging portion;

fastening means at said edges in the vicinity of said head-engaging portion for releasably securing said panel to the club shaft with said body portion extending away from the shaft and said head-engaging portion engaging the head's first end;

said body portion extending from said head engaging portion for draping over a second end of the head when said panel is secured to the shaft by said fastening means and the club is vertically positioned with the head above the shaft.

9. The combined wiper and head cover according to claim 8, wherein said body portion is confined substantially to one side of the club shaft when said panel is secured to the shaft by said fastening means with said head-engaging portion engaging the head's first end.

10. The combined wiper and head cover according to claim 8, wherein said pliant material is absorbent.

11. A combined wiper and cover for a club having a head attached to a shaft, the head including a heel end and a distal toe end, comprising:

a panel of pliant material having a body portion and a heel-engaging portion for engaging the heel end of the club head, said panel including two edges joined to one another at said heel-engaging portion;

fastening means at said edges in the vicinity of said heel-engaging portion for releasably securing said panel to the club shaft with said heel-engaging portion engaging the heel end;

said body portion extending from said heel-engaging portion for covering the club head and draping over the distal toe end when said panel is secured to the shaft by said fastening means and the club is vertically positioned with the head above the shaft.

12. The combined wiper and head cover according to claim 11, wherein said body portion extends beneath said club head and generally toward the head's distal toe end when said panel is secured to the club shaft by said fastening means with said heel-engaging portion engaging the head's heel end.

13. The combined wiper and cover according to claim 11, wherein said pliant material is absorbent.

14. The combined wiper and cover according to claim 11, wherein said pliant material is terry cloth.

15. Golf club and cover apparatus, comprising in combination:

a golf club having a head with a first end and an opposed second end, and a shaft attached to said head;

a panel of pliant material;

means engaging said panel with said first end of said club head such that said panel covers said head and drapes over said second end when said club is vertically positioned with said head above said shaft; and means releasably securing said panel to said club shaft and urging said panel to extend away from said shaft and generally toward said second end.

16. The apparatus of claim 15, wherein said first end is the heel end of said club head and said second end is the toe end of said club head forwardly of said shaft.

17. The apparatus of claim 16, wherein said panel extends beneath said club head generally toward said toe end when secured to said shaft by said securing means for substantially confining said draping panel forwardly of said shaft.

18. Golf club and cover apparatus, comprising in combination:

a golf club having a head and a shaft attached to said head, said head including a heel end and an opposed toe end forward of said shaft;

a panel of pliant material;

means engaging said panel with said heel end of said club head such that said panel covers said head and drapes over said toe end when said club is vertically positioned with said head above said shaft; and means releasably securing said panel to said club shaft with said panel extending beneath said club head and away from said shaft generally toward said toe end for substantially confining said draping panel forwardly of said shaft.

* * * * *